United States Patent [19]

Bernhardt

[11] Patent Number: 4,723,961

[45] Date of Patent: Feb. 9, 1988

[54] PROCESS AND AGENT FOR THE ONE-BATH REOXIDIZING AND SOAPING OF DYEINGS WITH VAT OR SULFUR VAT DYES WITH HYPOCHLORITE-RELEASING COMPOUNDS AND ANIONIC DETERGENTS

[75] Inventor: Heinrich O. Bernhardt, Kriftel, Fed. Rep. of Germany

[73] Assignee: Hoechst Aktiengesellschaft, Frankfurt am Main, Fed. Rep. of Germany

[21] Appl. No.: 905,632

[22] Filed: Sep. 9, 1986

[30] Foreign Application Priority Data

Sep. 11, 1985 [DE] Fed. Rep. of Germany ..... 3532341

[51] Int. Cl.[4] ..... D06P 1/22; D06P 3/82; D06P 5/02

[52] U.S. Cl. ..... 8/650; 8/593; 8/642; 8/652; 8/904; 8/908; 8/918

[58] Field of Search ..... 8/650, 652, 908, 911, 8/591, 593, 642

[56] References Cited

U.S. PATENT DOCUMENTS 4,488,880 12/1984 Bernhardt ..... 8/652

OTHER PUBLICATIONS

Colour Index (Third Edition), vol. 4 (Soc. Dyers and Colourists, 1971), pp. 4475–4476, 4497–4498.

Kirk–Othmer Encyclopedia of Chemical Technology, Third Edition, vol. 5, pp. 565–580.

Cordes, J. F. et al, "Chloramines", in *Ullmanns Encyclopadie der technischen Chemie,* 4th Ed., vol. 9, pp. 384–392.

*Primary Examiner*—A. Lionel Clingman

[57] ABSTRACT

The alkaline reoxidation of vat and sulfur vat dyes by means of hydrogen peroxide is difficult to control and to keep constant. By using agents which split off hypochlorite in the heat, for example sodium N-chloro-p-toluenesulfonamide, at pH values above 8 it is possible according to the invention even to reoxidize reliably combinations of these dyes having different oxidation behaviors. At the same time it became possible to combine the necessary soaping process with reoxidation.

13 Claims, No Drawings

PROCESS AND AGENT FOR THE ONE-BATH REOXIDIZING AND SOAPING OF DYEINGS WITH VAT OR SULFUR VAT DYES WITH HYPOCHLORITE-RELEASING COMPOUNDS AND ANIONIC DETERGENTS

The present invention relates to a process for one-bath reoxidizing and soaping of dyeings with vat and/or sulfur vat dyes (C.I. Vat Dyes) which have been applied beforehand in reduced form to a lextile material which contains cellulose fibers and have been fixed thereon, from an alkaline medium. This invention also relates to an oxidizing and aftersoaping agent for carrying out the claimed process.

It is common knowledge that, when dyeing cotton with vat and/or sulfur vat dyes, application of these colorants first requires their vating on the material and, following exhaustion and fixation, their development there by reoxidation. A subsequent soaping of the material thus treated is absolutely indispensable for obtaining optimal fastness properties and also the final hue of such dyeings.

There are new in existence various reoxidation processes for developing the two aforementioned dye categories—for implementation not only in an acid but also in an alkali medium—which all have their specific advantages, but also their typical disadvantages.

The development of ever more effective continuous dye application processes thus was also responsible for the trend in reoxidation toward the more intensively acting oxidants—a consequence of which was that the sensitivity of the dye species to such oxidizing substances became increasingly more important and necessitated even closer monitoring of the reoxidation process. Theis was found to be the case in particular for combination dyeings with dyes having different dyeing properties.

A further problem in relation to the feasibility of conventional reoxidation arose when the use of chromium salts as oxidants had to be dispensed with for environmental reasons.

On using the remaining oxidizing agents which are active in the alkaline range, such as hydrogen peroxide, peroxides or perborates, sodium chlorite or hypochlorite, it was found that they either are difficult to meter or, however, have an adverse effect on the shade. In some cases, they even cause reductions in fastness properties, for example wet fastness properties.

Yet German Offenlegungsschriften DE-A1-3,312,162 and DE-A1-3,338,267 surely have already explained that dyeings with sulfur dyes which have been applied in the reduced state to cellulose be subjected to the oxidizing action of the sodium salt of the N-chloramide of p-toluenesulfonic acid in the alkaline range to develop the dyes. However, the uniformity of the colorant used relieves the reoxidation process described of the need to allow, in the course of this treatment stage, for any different criteria in relation to the vulnerability of the leuco compound.

The general intention prevailing in the field, namely for economic reasons to dye in this area by using dyes from different product ranges—and hence also of different reoxidation behaviors—together, thus provides the invention in question with the object to design a reoxidation process for developing the dyes which are in each case present in the leuco form on the fiber; which is uniformly applicable; which causes no environmental pollution; which avoids the disadvantages of the processes known for this purpose; and which in addition is economical.

This object is achieved according to the invention by exposing the textile material which has been treated with the above dyes alone or in combination with one another—for dye development—to the oxidizing action of an aqueous solution of chemicals which split off hypochlorite when heated, at pH values above 8 and at a temperature between 15° C. and the boiling point of the liquor, and at the same time as the oxidation effecting or initiating in the same bath the soaping process with the aid of preferably anionic surfactants which are imprevious to hypochlorite. This can be done not only continuously but also batchwise.

Suitable representatives of those commpounds which split off hypochlorite in the heat and which are capable of giving off, in the course of the oxidation process, positively charged chlorine are according to the invention N-chlorinated organic sulfonamides such as N-chloro-aryl- or -alkylaryl-sulfonamides, or N-chlorinated isocyanuric acids. Examples which may be specifically mentioned in this respect are the sodium salts of N-cloro-p-toluene-sulfonamide, N-chlorobenesulfonamide, 3-carboxyl-1-chlorosulfonamoylbenzene or N-chloro-o-toluenesulfonamide, and also the corresponding dichlorine compounds such as N, N-dichloro-p-toluenesulfonamide and dichlorocyanuric acid, individually or in mixtures with one another which produce equivalent dyeing results. The substances just mentioned make available to the practical dyer inexpensive, physiologically safe oxidizing agents for developing vat and sulfur dyes, the end products of which present no water treatment problems. Their metering presents no problems and there are no difficulites with respect to the maintenance of color constancy. Such compounds are described inter alia in Ullmanns Encyclopädie der technischen Chemie [Ullmann's Encyclopedia of Technical Chemistry], 4th edition, Volume 9, pages 384 to 392 (in particular pages 388 to 389), and in kirk-othmer, Encyclopedia of Chemical Technology, Thrid Edition, Volume 5, pp. 565–580 (in particular pp. 574–575).

Eligible agents for soaping within the context of the claimed process are preferably anionic, hypochloriteimprevious surfactants, such as, for example, oleylmethyltaurine or sodium oleylisoathionate and the like, where appropriate with such assistants of the nonionic type. These surfactants are used according to the invention together with the abovementioned oxidizing agents from the same liquor.

The amounts in which the abovementioned oxidizing agents are used depend, according to the invention, on whether the continuous or batchwise method is used. The recommendation is in the case of the continuous process 1 to 4 g/l of the oxidants and 1 g/l of sodium carbonate in the starting liquors and 0.5 to 1% of the oxidant in the feed liquors. In batchwise wdorking, 0.5 to 2% of the oxidant (on weight of fiber) and 1 g/l of sodium carbonate have proved advisable.

The pH value of the claimed process can vary within wide limits without affecting the quality of the reoxidation of the leuco dyes, as long as it is ensured that alkaline medium (pH>8) prevails in the developing baths. Preferably the dye development is carried out at pH values in the range between 8 and 12, which are set either by the alkali which is present on the textile material from the proceding vating, or, preferably, by sepatate addition of, for example, sodium carbonate.

Since the time factor is not of major importance in the oxidation method according to the invention, the claimed process can be carried out not only contimuously but also batchwise. In trhe case of the continuous procedure being used, dwell times of the dyed material in the developing/soaping baths between 5 and 120 seconds are sufficient.

It is also the case that the temperature of the reoxidizing and soaping treatment is relatively uncritical to the process and can vary, depending on the composition of the dye conbination, between 30° C. and the boiling point (100° C.). While in the case of a combination of sulfur vat dyes only temperatures between 35° and 50° C. are used, in the case of combinations of vat and sulfur vat dyes 95° C. to boiling point is preferred.

To obtain complete soapoff of the dyeings with the vat and/or sulfur vat dyes, the actual oxidation bath is generally followed by further soaping baths which are set at higher temperatures (80° C. to boiling point). There is no need for including between the oxidation bath and the soaping bath rinse baths for removing unconsumed oxidizing agent.

In the case of the continous procedure, steaming of the textile material is generally followed by a brief rinse and immediately thereafter by the reoxidation/soaping. The reoxidation/soaping bath at 35° C. to boiling point then contains for example 1–4 g/l of the abovementioned oxidants,
1 g/l of calcined sodium carbonate and
1–3 g/l of oleylmethyltaurtine, or directly the corresponding amount of a ready-to-use mixture of these substances as described herinafter as oxidizing and aftersoaping agents according to the invention.

In the light of the know-how gained about the oxidizing/soaping process according to the invention, the present invention further extends to oxidizing and aftersoaping agents for carrying out the new process. This property right thus provides in this respect mixtures which contain 20 to 80 parts by weight of chemicals which split off hypochlorite in the heat, for example oxidizing agents of the type of N-chlorinated aryl-or alklaryl-sulfonamides and/or N-chlorinated isocyanuric acids, perferably of oxidizing compounds or mixtures thereof from the abovementioned selection, and 80 to 20 parts by weight of preferably anionic hypoclorite-resistant surfactants, for example of the type of oleylmethyltaurine and/or sodium oleylisethionate.

These are mixtures of the oxidizing agents mentioned with the surfactants mentioned, perferably in powder form. These mixtures can at the same time also contain the necessary alkalis, for example in the form of sodium carbonate, in an amount of 0 to 50% by weight of the total mixture.

Preferably the oxidizing and aftersoaping agents according to the present invention are composed of 20 to 80 parts by weight of the sodium salt of the N-chlorimde of p-toluensulfonic acid,
80 to 20 parts by weight of oleylmethyltaurine and
20 to 50 parts by weight of calcined sodium carbonate.

The new process is designed not only for the continuous but also for the batchwise oxidizing/soaping of dyeings with the dyes mentioned, irrespective of the form, for example, padding or printing or exhaust dyeing, in which the dyes have previously been applied to the textile material to be dyed. Irrespective of the manner of application, they are present after fixing in reduced form on the the fiber and must in each case be reoxidized to the insoluble dye. It follows that the claimed process can also include sulfur dyes of other origins, for example vated sulfur dyes (C.I. Sulphur Dyes), Leuco sulfur dyes (C.I. Leuco Sulphur Dyes) and sulphur dyes solubilized by thiosulfato groups (C.I. Solunilised Sulphur Dyes), as mentioned in German Offenlegungsschrifteen DE-A1-3,312,162 and DE-A1-3,338,267, as constituents of the dye mixtures to be used according to the invention.

The present invention is principally applicable to textile material which comprises polyester/celulose fiber mixtures, and in such a case the dye preparations which contain vat and/or sulfur vat dyes can thus additionally contain alkali-stable disperser dyes and can thus take an active part in coloring the polyester fiber component in the patterning process according to the invention.

The fixing of the disperse dyes, which are materially different from the other two types of dye, is effected before conversion of the vat and/or sulfur vat dyes into their reduced form (vating) and the subsequent reoxidation and soaping measures under alkaline conditions; this fixing cab be effected through thermosoling or in the HT exhaust method. This illustrates the advantages of this invention, that, on the one hand, by using agents which split off hypachlorite in the heat, a reliable and economical process for the alkaline reoxidation of vat and sulfur vat dyes, including in particular when in combination with one another, is achieved, which is superior to the known alkaline reoxidation with hydrogen peroxide, and, on the other hand, as a consequence of the mild oxidizing action of the chemicals used for the purpose according to the invention, no problems arise with respect to any disperse dyes involved. The fact that it is possible to include disperse dyes as well is a development of the invention which significantly enriches the new process, since commercially available ranges of dye mixturs on the abovementioned basis, in which combinations not only of disperse and vat dyes but also of disperse and sulfur vat dyes are present side by side, can then be oxidized together and thus be used without attendant coloring problems for the simultaneous coloration of the two fiber types.

The percentages given in the examples below are by weight and in the case of liquor pickup data are based on the weight of the dry textile material.

EXAMPLE 1

A 100% cotton fabric is treated by the so-called padsteam process for vat dyes with 10 g/l of the dye Vat Red 14 having the C.I. no 71110 by padding the cloth from a warm aqueous medium at 25° C. with a ph value of about 5.5 in the presence of an anionic surfactant with a pigment suspension of the insoluble colorant using a liquor pickup of 45%, and then drying at about 115° C. This impregnation is then overpadded with an aqueous vating liquor based on hydrosulfite/sodium hudroxide solution with a 60% liquor pickup and, to reduce the dye by conversion into the leuco form and to fix the same on the fiber, is briefly steamed with air-free saturated steam at 105° C.

To re-form the colored pigment and to soap the vat dyeing produced, the procedure aftere leaving the steamer is then as follows:

The textile material is first rinsed with cold water in the first twop boxes of the open-width washer used for carrying out the abovementioned operations. While passing through the 3rd and 4th compartment (dwell time on average 20 sec), the leuco dye applied to the fabric is reoxidized at 95° C. through the action of aqueous baths containing 3 g/l of sodium N-chloro-p-toluenesulfonamide,
1 g/l of calcined sodium carbonate and
1 g/l of oleylmethltaurine, and the dyeing which is developed in the course of this treatment is simultaneously soaped and is then subjected to a further soaping at 98° C. in the 5th compartment which has been charged with an aqueous liquor to which has been added 0.5 g/l of sodium carbonate and
0.5 g/l of oleylmethyltaurine, In compartments 6 and 7 the material thus dyed is rinsed once more with water and is soured off by means of a liquor containing 3 g/l of acetic acid. Finally, the tetile material is sprayed down and finished.

Despite the difficult reaxidizabiltity of the dye used in this example, the process fo the invention procduces a fully oxidized and soaped-off scarlet dyeing of the fabric, as comaprisons with samples carefully oxidized in conventional manner have shown.

EXAMPLE 2

80 kg of a 100% cotton yarn on cones are dyed in a yarn dyeing apparatus in a liquor ratio of 10:1 and under alternating circulation direction with an aqueous liquor which, on weight of dry fiber, contains 3% of the sulfur vat dye Vat Blue 43 having the C.I. No. 53630 and also

5 $cm^3$/l of 32.5% strength sodium hydroxide solution,
4 g/l of hydrosulfite and
2 g/l of a low-foam wetting agent mixture based on a combination of anionic and nonionic surfactants by the customary exhaust method at 90° C. in the course of 45 min.

The bath, including the textile material treated in this way, is then cooled down to 70° C., and the latter is initiatlly rinsed clear with water under overflow conditions. To develop the dye by reoxidation and at the same time to soap off the resulting dyeing, the rinse liquor then has added to it, without change of bath, 1% of sodium N-chloro-p-toluenesulfonamide,
1 g/l of sodium carbonate and
1 g/l of oleylmethyltaurine.

This bath is first heated to 40° C. and is maintained at that temperature for 10 to 15 min, the bath is then replenished by half and a further 0.5 g/l of oleylmethlytaurine are added, and the material thus dyed is then soaped at the boil for a further 10 min. Renewed rinsing and drying completes the dyeing process.

A deep, fast blue dyeing is obtained on the cones. Unlike conventional oxidation by means of hydrogen peroxide from and alkali medium, the process according to the invention does not lead to color deviation betwen the cover and the inner layers of the cones, nor to any reduction in the wash fastness of the dyeing.

EXAMPLE 3

A polyester fiber/cotton blend fabric (in a ratio of 65:35) is to be dyed fast by means of a continuous technique with dye mixtures of disperse dyes and vat or sulfur vat dyes. To this end an aqueous padding liquor is prepared to contain 30 g/l of a commerically available dye mixture of 17.5% of the blue disperse dye of the formula

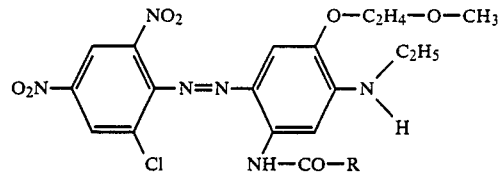

R=$CH_3$ or $C_2H_5$ in a ratio of 2:1

2.7% of the red disperse dye of the formula

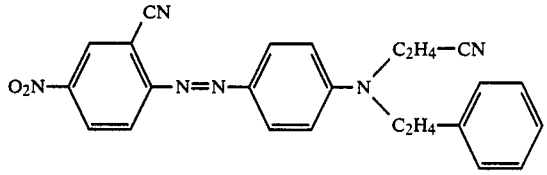

and 16.5% of the sulfur vat dye Vat Blue 43 having the C.I. No. 53630, 10 g/l of a commerically available dye mixture of 8.5% of the orange disperse dye of the formula

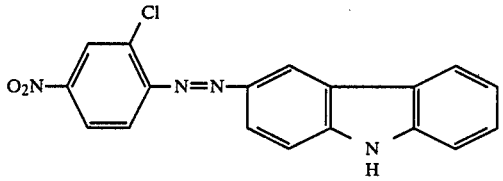

2.4% of the yellow disperse dye of the formula

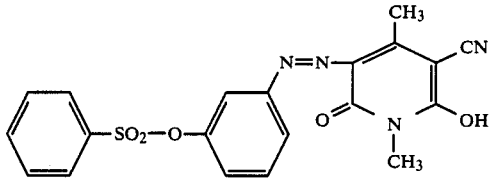

2.8% of the blue disperse dye of the formula

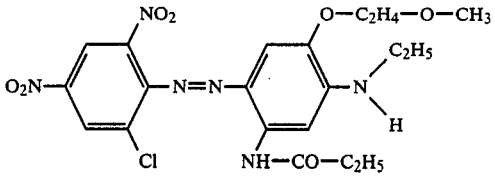

and 26.2% of the vat dye Vat Green 14 having the C.I. No. 58830, and also, 10 g/l at a padding assistant with thickening action based on a polyacrylic derivative and also
2 g/l of a wetting agent based on a combination of anionic and nonionic surfactants, and to have a pH value of 6 after adjustment with acetic acid.

The liquor thus prepared is then used to pad the textile material at room temperature with a liquor pickup of 60%, whereafter the dyed material is continously dried at 120° C. and thermosoled at 215° C. for 1 min.

To obtain vating, this impregnation is subsequently overpadded with a wet pickup of 60% with an aqueous liquor containing 100 $cm^3/l$ of 32.5% strength soduum hydroxide solution and 55 g/l of hydrosulfite, and is steamed at 102° C. in the absence of air for 60 sec.

To obtain dye development, the blend fabric thus treated is passed through an open-width washer and is rinsed therein in the first two comparments initially with cold water and then in the 3rd compartment with water at 50° C. The 4th and 5th compartment then features in the course of the action of a hot aqueous developing bath at 98° C. comprising 4 g/l of sodium N-chloro-p-toluenesulfonamide 1 g/l of calcined sodium carbonate and 1 g/l of oleylmethyltaurine the reoxidation of the leuco dyes fixed on the substrate, together with simultaneous soaping of the dyeing produced. In the following further compartments, the dyeing is rinsed once more with water, is soured off by means of acetic acid an after further rinsing is finally finished. Drying leaves a tone-on-tone navy dyeing of the blend fabric on both fiber components.

When the same dyeing is subjected to a conventional alkaline reoxidation with hydrogen peroxide, the dyeing result is problematical on account of the different reoxidation behaviors of vat and sulfur vat dyes and, not infrequently, leads to shade differneces within a given lot. Using the reoxidation/soaping process according to the invention, by contrast, thes difficulties are unlikely.

EXAMPLE 4

240 kg of a polyester/cotton blend yarn (in the ratio of 65:35) on cones are to be dyed in an HT dyeing apparatus at a liquor ratio 12:1 by the exhaust method. The aqueous liquor which is proposed for this purpose and which, on weight of dry fiber, contains 2.8% of a commercially available dye mixture of 17.5% of the blue disperse dye of the formula

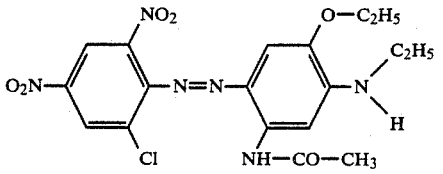

2.7% of the red disperse dye of the formula

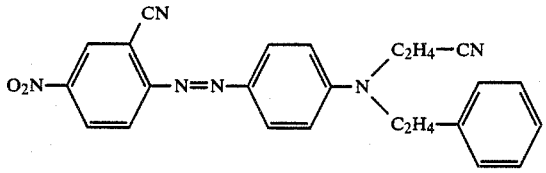

and 16.5% of the sulfur vat dye Vat Blue 43 having the C.I. No. 53630, 0.2% of a commercially available dye mixture of 13.1% of the orange disperse dye of the formula

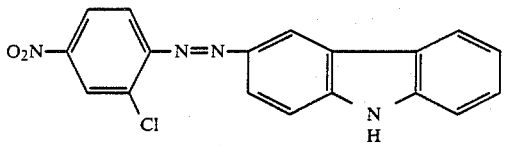

0.75% of the red disperse dye of the formula

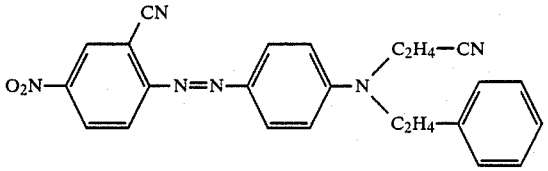

15% of the vat dye Vat Yellow 33 having the C.I. No. 65429 and

5% of the vat dye Vat Red 14 having the C.I. No. 71110 and also 1.5 g/l of the sodium salt of 2,2'-dinaphthylmethane-6,6'-disulfonic acid (as dispersant)

is made up at 60° C. and is brought to pH 4.5 with acetic acid.

The dyeing liquor thus prepared is then heated up to 135° C., and the textile material is then dyed therwith at that temperature for 35 minutes under alternating direction of circulation. After the bath and the yarn cones treated in this way have cooled down to 80° C., the dyeing vessel has added to it about without prior liquor change and in the stated order first 15 $cm^3/l$ of 32.5% strength sodium hydroxide solution and 5 g/l of hydrasulfite and after a further 10 minutes of circulation also 20 g/l of calcined sodium sulfate and at 80° C., while liquor circulation continues, the textile material is left for a total of 30 minutes under influence of the reduction conditions used for the purpose of dye vating.

After discharging the previous bath, the textile material is rinsed with water, and through the action of an aqueous developing bath containing in the same liquor ratio of 12:1 6 kg of a mixture of 40% of oleylmethyltaurine, 40% of sodium N-chloro-p-toluenesulfonamide and 20% of calcined sodium carbonate the leuco dye exhausted onto the fiber material is reoxidized at 80° C. and the dyeing produced is at the same time soaped. A further soap at the boil for about 10 minutes in aqueous medium containing 0.5 g/l of oleylmethyltaurine and 0.5 g/l of sodium carbonate and further warm and cold rinse with water than complete the dyeing.

The result obtained is a level navy dyeing of a blend yarn on the two fiber components.

If, by contrast, the reoxidation to develop the leuco dyes involved in accordance with the above dyeing recipe is effected under conventional conditions in an alkaline bath by means of 2% of 33% strength hydrogen peroxide and 1 g/l of calcined sodium carbonate at 60° C., then the dyeing result is in danger, through unequal oxidation of the vat and sulfur vat dye portions, of forming a color deviation between the outer and inner layers on the yarn package thus treated.

I claim:

1. In a process for reoxidizing dyeings with vat and/or sulfur dyes which have been applied beforehand in reduced form to a textile material which contains cellulose fibers and have been fixed thereon, from an alkaline medium, wherein the textile material which has been treated with the above dyes alone or in combination with one another is exposed - for the dye development - to the oxidizing action of an aqueous solution of an oxidizing agent or mixture thereof selected from an N-chlorinated aryl- or alkylaryl-sulfonamide and N-chlorinated isocyanuric acid, at pH values above 8 and at a temperature between 15° C. and the boiling point of the liquor, the improvement which comprises effecting the first soaping process of the fixed dyeing at the same time as the oxidation in the same bath, said liquor containingg anionic surfactants in addition to the oxidizing agent or mixture, under the above temperature and pH conditions.

2. The process as claimed in claim 1, wherein the liquor additionally contains a nonionic surfactant.

3. The process as claimed in claim 1, wherein the oxidizing agents used are the sodium salts of N-chloro-p-toluenesulfonamide, N-chlorobenzenesulfonamide, 1-chlorosulfamoyl-3-carboxylbenzene or N-chloro-o-toluenesulfonamide, or N,N-dichloro-p-toluenesulfonamide or dichloroisocyanuric acid individually or in mixture with one another.

4. The process as claimed in claim 1, wherein the anionic surfactants used are oleylmethyltaurine or sodium oleyl isethionate individually or in mixture with one another.

5. The process as claimed in claim 1 wherein said reoxidizing and soaping are effected at temperatures of 35° to 100° C.

6. The process as claimed in claim 1, wherein said reoxidizing and soaping are both effected at pH values of 8 to 12.

7. The process as claimed in claim 1, wherein said reoxidizing and soaping are both carried out continuously.

8. The process as claimed in claim 1, wherein said reoxidizing and soaping are bath carried out batchwise.

9. The process as claimed in claim 1, for the one-bath reoxidizing and soaping of dyeings with vat and/or sulfur dyes on textile material comprising polyester/cellulose fiber mixtures, wherein the preparations which contain the above dyes alone or in combination with one another additionally contain alkalistable disperse dyes and the disperse dyes thus applied are fixed before converting the vat and/or sulfur dyes into their reduced form.

10. An oxidizing and aftersoaping agent for carring out the process as claimed in claim 1, which contains a mixture of:

20 to 80 parts by weight of oxidizing agents of the type N-chlorinated aryl- or alkylarly-sulfonamides and/or N-chlorinated isocyanuric acids and 80 to 20 parts by weight of anionic surfactants of the type oleylmethyltaurine and/or sodium oleyl isethionate.

11. The oxidizing and aftersoaping agent as claimed in claim 11, wherein for oxidation the sodium salts of N-chloro-p-toluenesulfonmaide, N-chlorobenzenesulfonamide, 1-chlorosulfamoyl-3-carboxylbenzene or N-chloro-o-toluenesulfonamide or dichloroisocyanuric acid are provided individually or in mixture with one another.

12. An oxidizing and aftersoaping agent for carrying out the process as claimed in claim 7, comprising a mixture of 20 to 80 parts by weight of sodium N-chloro-p-toluenesulfonamide, 80 to 20 parts by weight of oleylmethyltaurine and 20 to 50 parts by weight of calcined sodium carbonate.

13. A process for the one-bath reoxidizing and scaping of a previously applied dyeing which is in a reduced form of a vat and/or sulfur dye previously applied from an alkaline medium and fixed on a textile material containing cellulosic fibers, siad process comprising;

in a bath containing a reoxidizing agent and a soaping medium, developing said reduced form by exposing said textile material, on which said dyeing is fixed, to the oxidizing action of an aqueous solution of a reoxidizing agent which splits off hypochlorite when heated above 15° C. but below the boiling point of the bath at a pH value $>8$, and at the same time, in the same bath, effecting a soaping step with the aid of the soaping medium, which medium comprises an anionic, hypochlorite-resistant surfactant.

* * * * *